US007954167B2

(12) United States Patent
Leathers

(10) Patent No.: US 7,954,167 B2
(45) **Date of Patent: *Jun. 7, 2011**

(54) BODY ARMOR AND CLOSURE MECHANISM FOR USE IN BODY ARMOR

(75) Inventor: Kathryn Ann Leathers, Neosho, MO (US)

(73) Assignee: Mine Safety Appliances Company, Cranberry Township, PA (US)

( * ) Notice: Subject to any disclaimer, the term of this patent is extended or adjusted under 35 U.S.C. 154(b) by 100 days.

This patent is subject to a terminal disclaimer.

(21) Appl. No.: 12/436,741

(22) Filed: May 6, 2009

(65) Prior Publication Data

US 2009/0217437 A1 Sep. 3, 2009

Related U.S. Application Data

(63) Continuation of application No. 11/405,221, filed on Apr. 17, 2006, now Pat. No. 7,536,728.

(60) Provisional application No. 60/688,884, filed on Jun. 9, 2005.

(51) Int. Cl.
*F41H 1/02* (2006.01)
*F41H 1/04* (2006.01)
*F41H 1/00* (2006.01)

(52) U.S. Cl. ..... 2/2.5; 428/911

(58) Field of Classification Search ..... 2/2.5; 428/911
See application file for complete search history.

(56) References Cited

U.S. PATENT DOCUMENTS 3,452,362 A * 7/1969 Korolick et al. ..... 2/2.5
3,557,384 A * 1/1971 Barron et. al. ..... 2/2.5
3,577,836 A * 5/1971 Tamura ..... 2/2.5
4,608,717 A * 9/1986 Dunbavand ..... 2/2.5
5,024,360 A * 6/1991 Rodriguez ..... 2/102
5,317,950 A * 6/1994 Binon et al. ..... 89/36.02
5,331,683 A * 7/1994 Stone et al. ..... 2/2.5
5,373,582 A * 12/1994 Dragone et al. ..... 2/2.5
5,479,659 A * 1/1996 Bachner, Jr. ..... 2/2.5
5,495,620 A * 3/1996 Schoenweiss et al. ..... 2/2.5
5,495,621 A * 3/1996 Kibbee ..... 2/2.5
5,754,982 A * 5/1998 Gainer ..... 2/2.5
5,789,327 A * 8/1998 Rousseau ..... 442/135
5,797,140 A * 8/1998 Davis et al. ..... 2/2.5
5,810,699 A * 9/1998 Nadeau ..... 182/105
5,918,309 A * 7/1999 Bachner, Jr. ..... 2/2.5
5,974,585 A * 11/1999 Bachner, Jr. ..... 2/2.5

(Continued)

*Primary Examiner* — Bobby H Muromoto, Jr.

(74) *Attorney, Agent, or Firm* — James G. Uber

(57) ABSTRACT

A body armor to be worn by a person includes a front section including ballistic paneling. The front section further includes at least a first front laterally extending section on a first side of the body armor. The first front laterally extending section includes ballistic paneling. The body armor further includes a rear section comprising ballistic paneling and at least a first rear laterally extending section attached to the rear section on the first side of the body armor and extending from the rear section. The first rear laterally extending section is connected to the first front laterally extending section so that when the first rear laterally extending section is moved forward around a first side of a torso of the person during closure of the first side of the body armor, the first front laterally extending section is pulled to move in a rearward direction around the first side of the torso of the person and under the first rear laterally extending section, thereby causing overlapping of at least a portion of ballistic paneling of the first front laterally extending section with at least a portion of ballistic paneling of the rear section around the first side of the torso.

15 Claims, 8 Drawing Sheets

U.S. PATENT DOCUMENTS 6,175,958 B1 * 1/2001 Wu ..... 2/2.5
6,185,738 B1 * 2/2001 Sidebottom ..... 2/2.5
6,408,440 B1 * 6/2002 Phillips ..... 2/102
6,698,024 B2 * 3/2004 Graves et al. ..... 2/2.5
6,874,163 B2 * 4/2005 Marshall ..... 2/102
6,948,188 B2 * 9/2005 D'Annunzio ..... 2/102
7,020,897 B2 * 4/2006 Johnson ..... 2/102
7,047,570 B2 * 5/2006 Johnson ..... 2/102
7,090,102 B1 * 8/2006 Lipke ..... 224/250
7,536,728 B1 * 5/2009 Leathers ..... 2/2.5

* cited by examiner

BODY ARMOR AND CLOSURE MECHANISM FOR USE IN BODY ARMOR

CROSS-REFERENCE TO RELATED APPLICATION

This application is a continuation of U.S. patent application Ser. No. 11/405,221, filed Apr. 17, 2006, which claims the benefit of U.S. Provisional Patent Application No. 60/688,884, filed Jun. 9, 2005, the disclosures of which are incorporated herein by reference.

BACKGROUND OF THE INVENTION

The present invention relates generally to body armor and to a closure mechanism for use in body armor, and, particularly, to body armor for the torso including a self-adjusting side closure mechanism.

Concealable body armor for protection from, for example, edged weapons, sharp objects and ballistic threats, has been available for several decades. Since the introduction of concealable body armor, ballistic materials have been improved greatly, resulting in relatively soft or pliant body armor and increased comfort for the user. Modern concealable body armor often includes ballistic panels or packages formed from DuPont's KEVLAR® ballistic grade fibers/fabrics.

Various closure systems have been developed for body armor including, for example, zippers and hook-and-loop type fastening systems (for example, VELCRO® available from Velcro Industries B.V.). In the case of closure systems for use in body armor it is desirable to have ballistic paneling cover or underlie the closure mechanism to prevent injury in the area of the body over which the closure mechanism is located. A side closure can be desirable to provide increased safety. In that regard, a person wearing body armor will typically be facing an assailant during an attack. Thus, impact of a dangerous object such as a bullet with the side of the wearer is less likely than impact of the object with the front of the wearer. As compared to a front closure mechanism, a side closure mechanism can thus reduce the likelihood of an object such as a bullet passing through the protection of the body armor in the area of the closure mechanism.

In the case of a side closure mechanism including overlapping ballistic paneling, it is desirable that a portion of a front ballistic panel overlap a portion of a back ballistic panel in the region of the side closure. In that regard, there have been cases with a back-to-front overlap in which a bullet has passed into the interior of the body armor by entering the body armor at the end point of the overlap. Once again, a person wearing body armor is most likely to be facing an assailant and any potential entry point for a projectile approaching the person from the front of the person is preferably eliminated. Although a front-to-back overlap may be desirable, a front-to-back overlap is difficult to achieve in practice. In that regard, it is very difficult for a wearer of body armor (for example, a vest) to achieve an effective front-to-back overlap while wearing the body armor. It is much easier for a wearer of body armor to achieve a back-to-front overlap.

It is desirable to develop improved body armor and closure mechanisms for use in body armor that reduce or eliminate the above-identified and other problems associated with currently available body armor and closure mechanisms therefor.

SUMMARY OF THE INVENTION

In one aspect, the present invention provides body armor to be worn on the torso of a person. The body armor includes a front section having ballistic paneling therein and a back section having ballistic paneling therein. The body armor further includes at least one side closure mechanism including a rearward section adapted to be grasped and pulled in a forward direction around the side of the torso to close the closure mechanism. The rearward section is in operative connection with a forward section of the side closure mechanism so that the forward section moves in a rearward direction around the side of the torso of the person when the rearward section is pulled in a forward direction. The forward section is in operative connection with a portion of the ballistic paneling of the front section so that a portion of the ballistic paneling in the front section overlaps a portion of the ballistic paneling in the back section that extends around a portion of the side of the torso when the closure mechanism is in a closed position. The rearward section and the forward section further include cooperating fastening mechanisms to reversibly retain the closure mechanism in a closed state.

The body armor can, for example, include a length of material attached at a first end to the rearward section and attached at a second end to the forward section. The length of material passes through a loop attached to the article of body armor. In one embodiment, the cooperating fastening mechanisms of the rearward section and the forward section are hook-and-loop type fastening mechanisms.

In another aspect, the present invention provides body armor to be worn on the torso of a person comprising a vest including a front section having ballistic paneling and a back section having ballistic paneling. The vest further includes at least one side closure mechanism including a rearward section adapted to be grasped and pulled in a forward direction around the side of the torso to close the closure mechanism. The rearward section is in operative connection with a forward section of the side closure mechanism so that the forward section moves in a rearward direction around the side of the torso of the person when the rearward section is pulled in a forward direction. The forward section is in operative connection with a portion of the ballistic paneling of the front section so that a portion of the ballistic paneling in the front section is adapted to overlap a portion of the ballistic paneling in the back section that extends around a portion of the side of the torso when the closure mechanism is in a closed position. The rearward section and the forward section include cooperating fastening mechanisms to reversibly retain the closure mechanism in a closed state. The cooperating fastening mechanisms of the rearward section and the forward section can, for example, be hook-and-loop type fastening mechanisms.

In one embodiment, the body armor further includes a length of material attached at a first end to the rearward section and attached at a second end to the forward section. The length of material passes through a loop attached to the article of body armor.

In a further embodiment, the vest is attached to a shirt. In that embodiment, the portion of the back section of ballistic paneling that extends around a portion of the side of the torso can be operatively attached to the shirt and at least a part of the portion of front section ballistic paneling that is adapted to overlap the portion of the back section of ballistic paneling can be free to move relative to the shirt.

In still a further aspect, the present invention provides a side closure mechanism for body armor including a back-to-front overlapping closing mechanism wherein closing of the closing mechanism results in a front-to-back overlap of ballistic paneling in the area of the closure mechanism.

BRIEF DESCRIPTION OF THE DRAWINGS

Other aspects of the invention and advantages thereof will be discerned from the following detailed description when read in connection with the accompanying drawings, in which.

DETAILED DESCRIPTION OF THE INVENTION

Figure 1A:
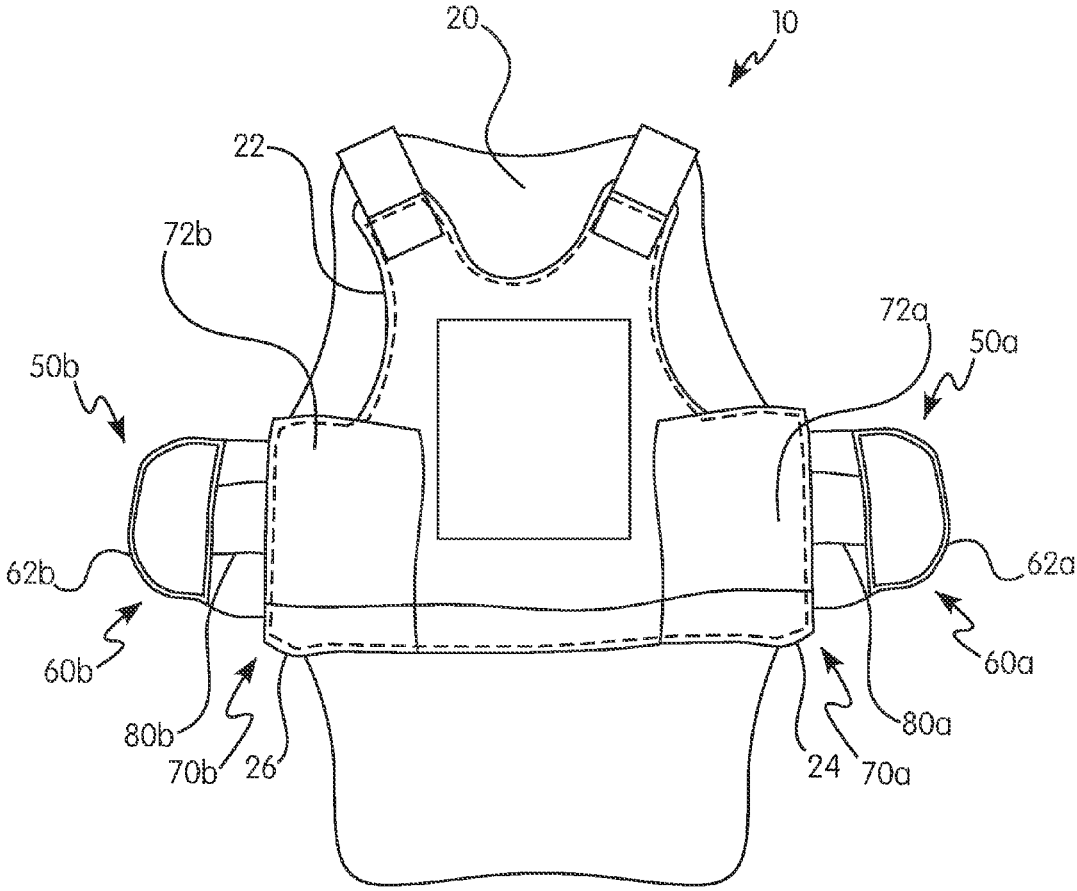
FIG. 1A is an embodiment of an article of body armor of the present invention laid flat on a surface.
Figure 1B:
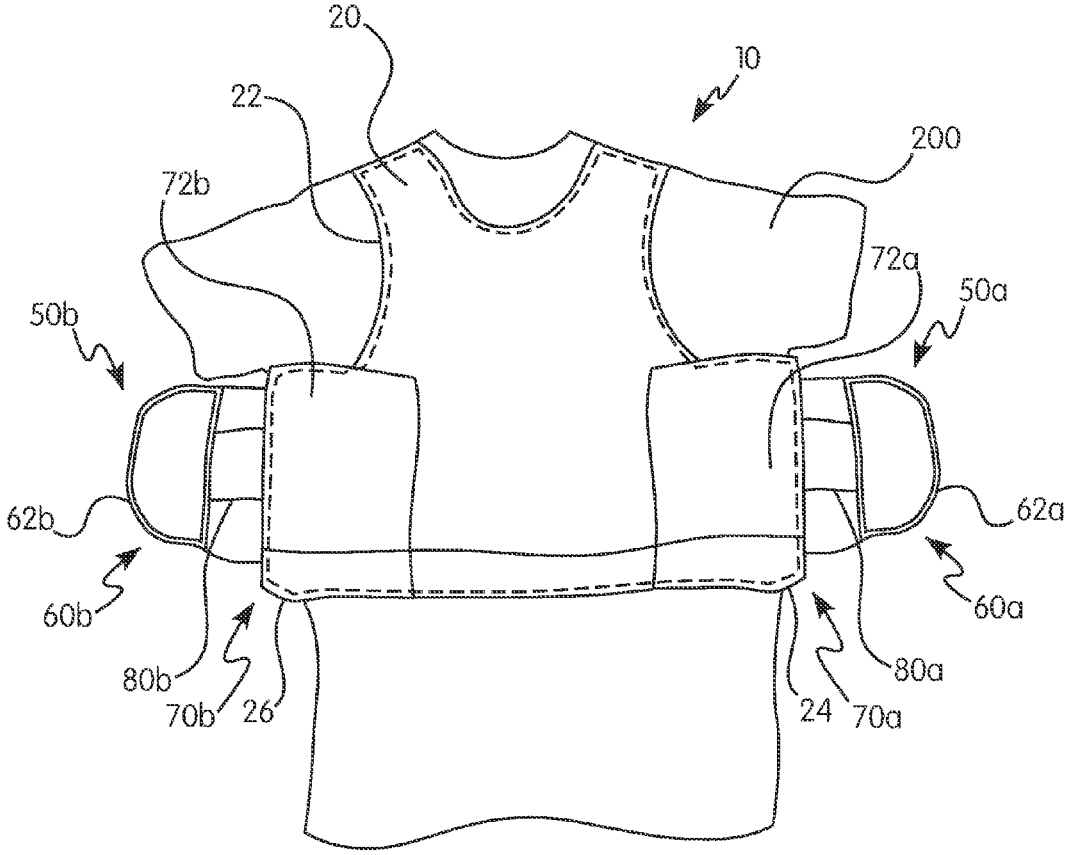
FIG. 1B is a front view of the body armor of FIG. 1A wherein the body armor is in the form of a pull over shirt having attached thereto a ballistic vest.
Figure 2:
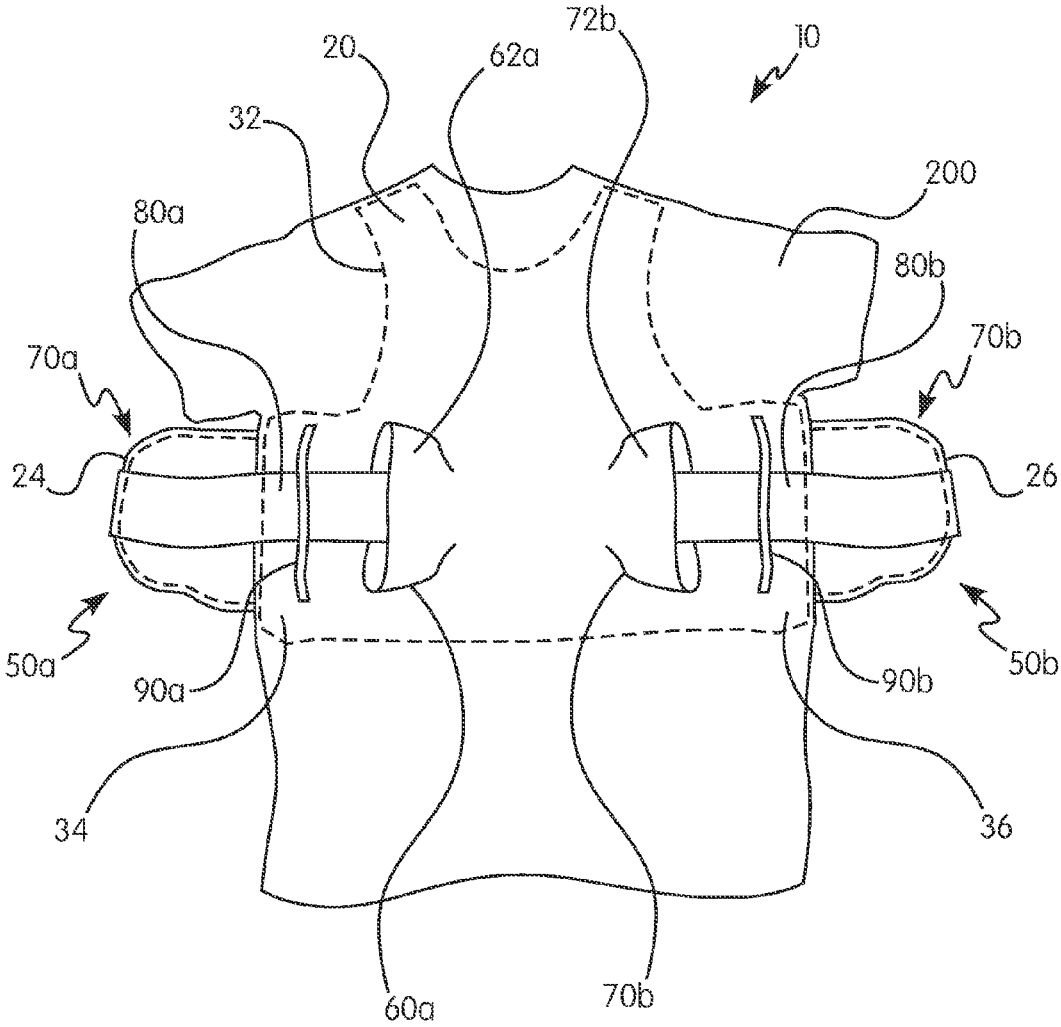
FIG. 2 illustrates a back view of the article of body armor of FIG. 1A wherein the body armor is laid flat on a surface and the rear closure sections of the opposing closure mechanisms are folded back.
Figure 3:
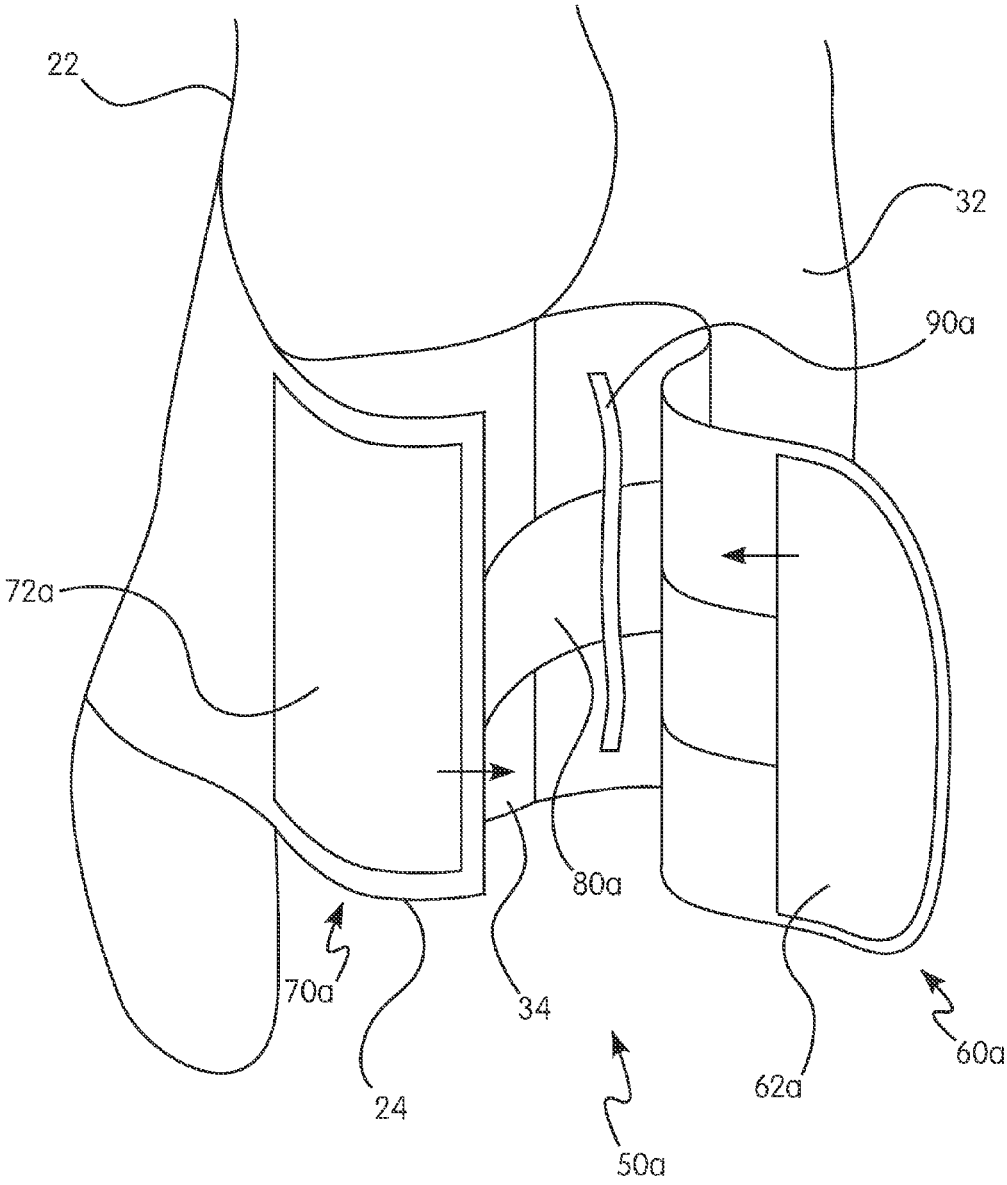
FIG. 3 illustrates a perspective view of an embodiment of a side closure mechanism of the article of body armor of FIG. 1A and the body armor is not worn on a user.
Figure 4:
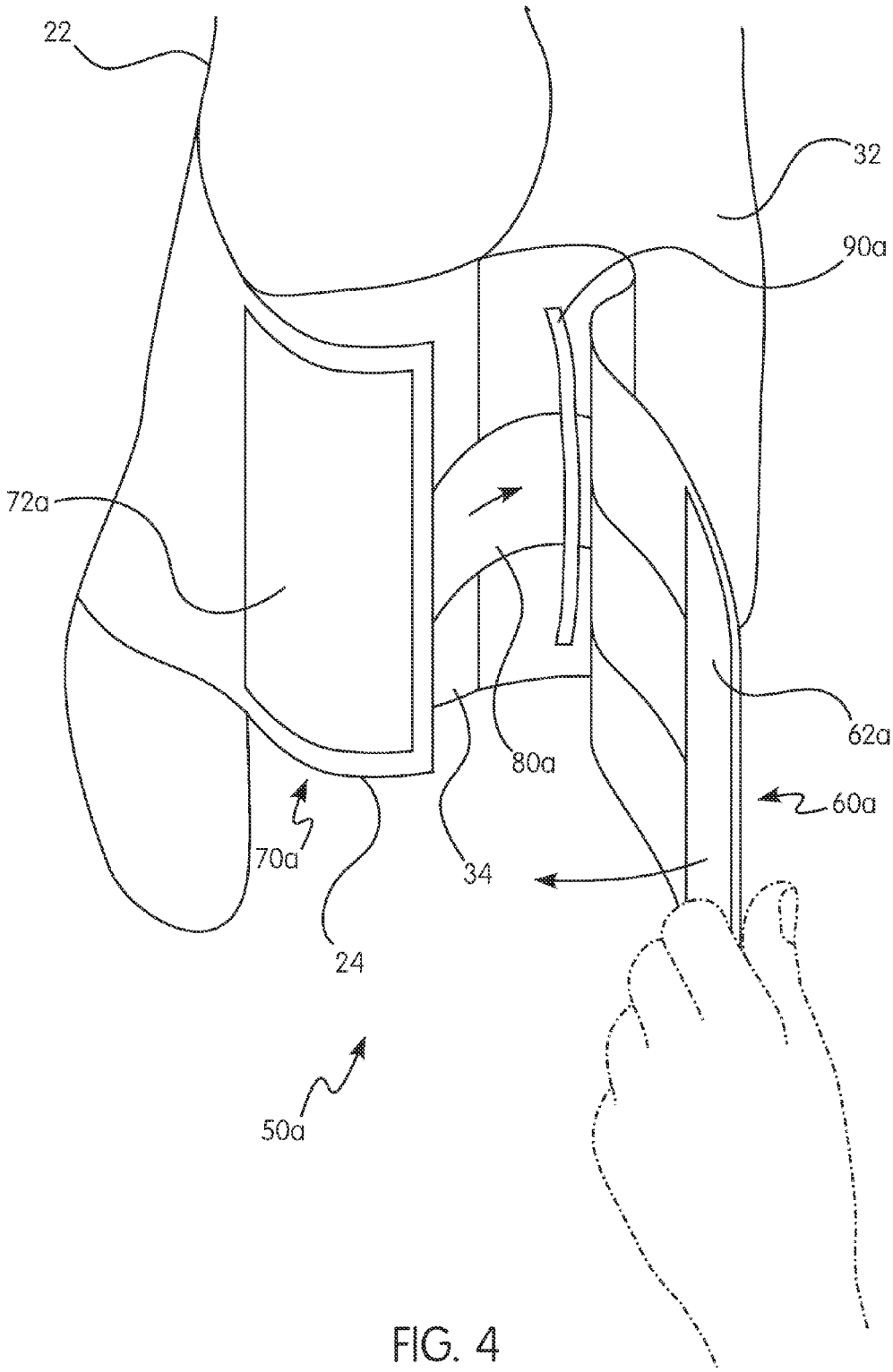
FIG. 4 illustrates another perspective view of the side closure of FIG. 3 wherein force is being applied to the rearward section thereof and the body armor is not worn on a user.
Figure 5:
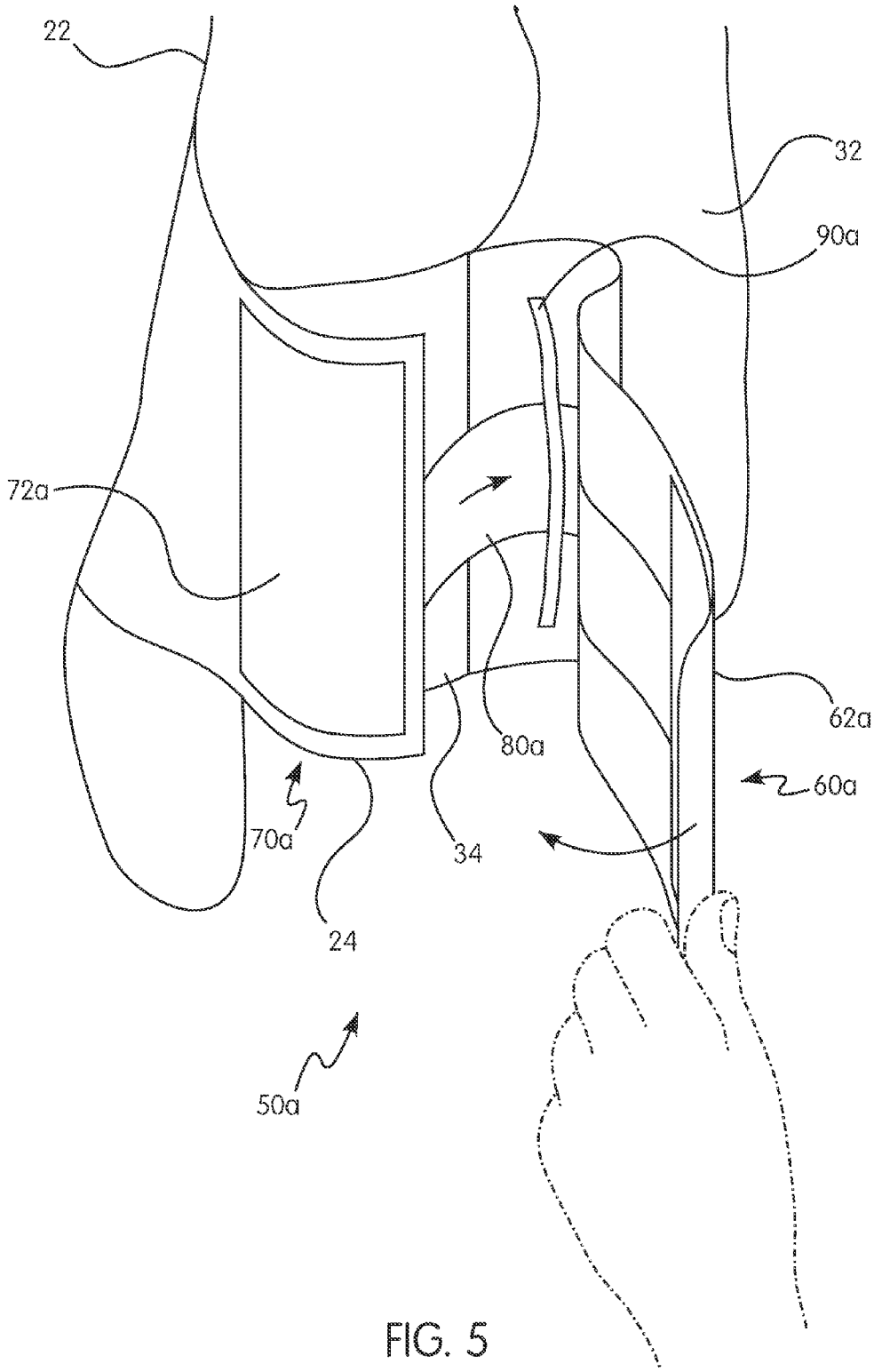
FIG. 5 illustrates another perspective view of the side closure of FIG. 3 wherein force is being applied to the rearward section thereof and the body armor is not worn on a user.
Figure 6A:
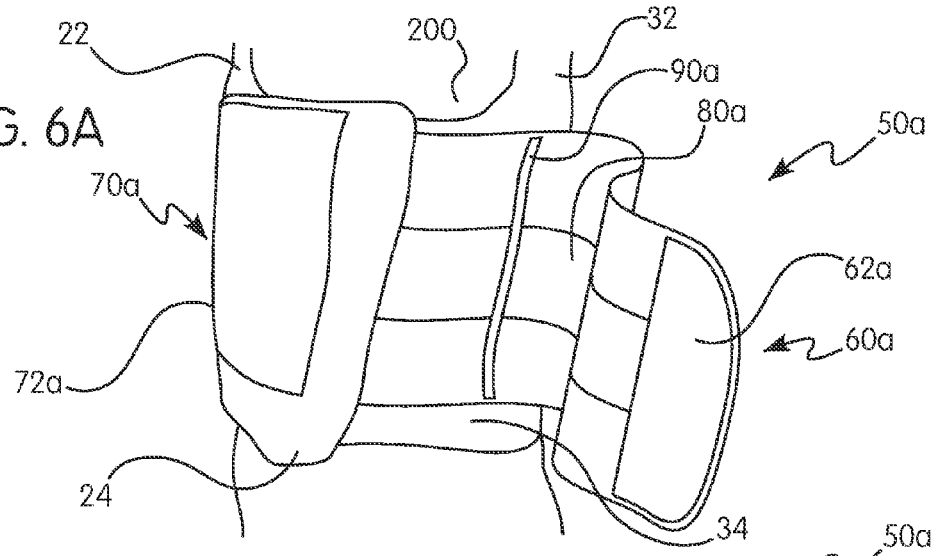
FIG. 6A illustrates a perspective view of the closure mechanism of FIG. 3 in an open state when worn by a user.
Figure 6B:
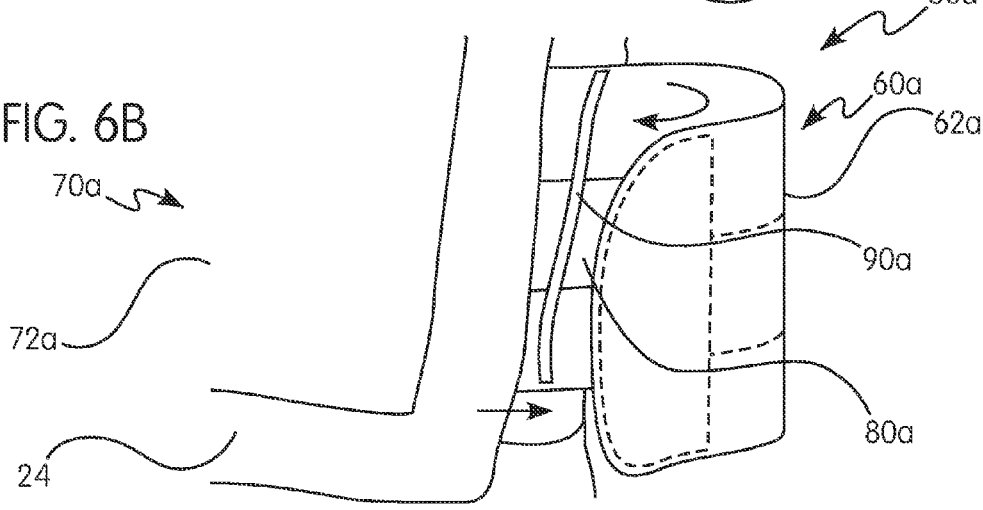
FIG. 6B illustrates a perspective view of the closure mechanism of FIG. 3 in the process of being closed when worn by a user.
Figure 6C:
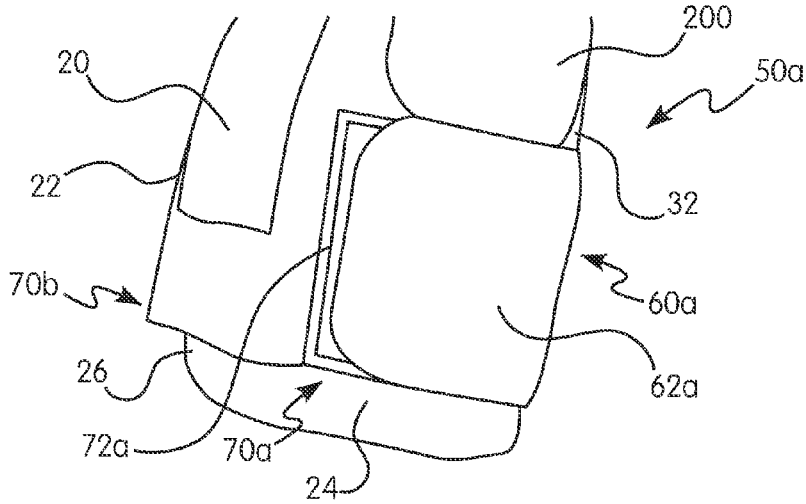
FIG. 6C illustrates a perspective view of the closure mechanism of FIG. 3 in a closed state when worn by a user.
Figure 7:
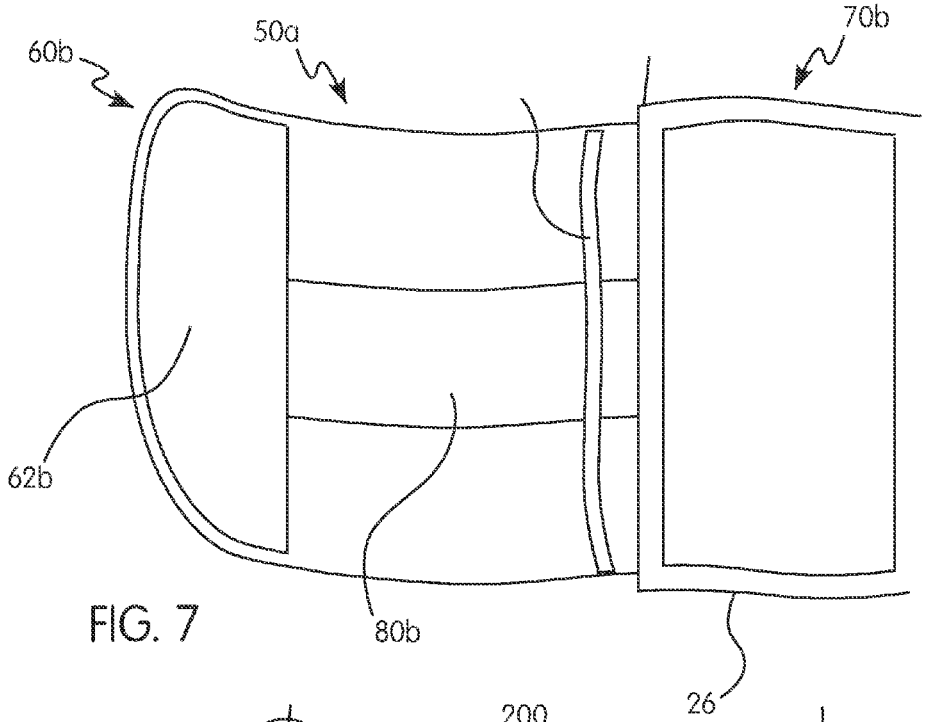
FIG. 7 illustrates a perspective view of a second side closure of the body armor of FIG. 1A positioned on the opposite side of the side closure illustrated in FIG. 3.

In general, the present invention provides a side closure mechanism or system for body armor in which the wearer effects a back-to-front closing or fastening of the side closure mechanism, but such closing results in a front-to-back overlap of ballistic paneling in the area of the closure mechanism.

FIGS. 1 through 8 illustrate an embodiment of an article of body armor 10 of the present invention in which a body armor vest 20 is in operative connection with a shirt 200. For example, an exterior shell fabric of the body armor can be sewn to the shirt. A user of body armor 10 first dons shirt 200 by pulling shirt 200 over the user's head in a typical fashion. The user can then adjust the fit of body armor vest 20 using one or more side closure mechanisms as described below. One skilled in the art appreciates that the side closure mechanisms of the present invention are suitable for use in many different configurations of body armor other than the configuration illustrated in FIGS. 1 through 8.

As is common with a number of body armors, body armor 10 includes ballistic panels (fabricated, for example, from ballistic grade KEVLAR® available from DuPont) that provide resistance to, for example, edged weapons, sharp objects, and ballistic threats. As illustrated with dashed lines in, for example, FIG. 1A, vest 20 includes a generally contiguous (in coverage) front ballistic panel 22. One skilled in the art appreciates that ballistic panel 22 can be formed from one section or a plurality of separate sections of ballistic fabric. However, the coverage provided by ballistic panel 22 is preferably contiguous. Front ballistic panel 22 includes sides sections 24 and 26 adapted to extend around the side of a user. Ballistic panel 22, including side sections 24 and 26, is enclosed within an outer shell of fabric forming the front of vest 20. As illustrated with dashed lines in, for example, FIG. 2, vest 20 also includes a generally contiguous (in coverage) rear ballistic panel 32. Like front ballistic panel 22, rear ballistic panel 32 can be formed from one section or a plurality of separate sections of ballistic fabric. Rear ballistic panel 32 includes sides sections 34 and 36 adapted to extend around the side of a user. Like ballistic panel 22, ballistic panel 32, including side sections 34 and 36, is enclosed within an outer shell of fabric forming the rear of vest 20.

FIGS. 3 through 8 illustrate the operation of side closure mechanisms 50*a* and 50*b* of vest 20. The structure and operation of side closure mechanisms 50*a* and 50*b* are essentially identical. Such structure and operation will be described primarily with reference to side closure mechanism 50*a*. Like components of side closure mechanism 50*a* and 50*b* are correspondingly numbered.

Figure 8:
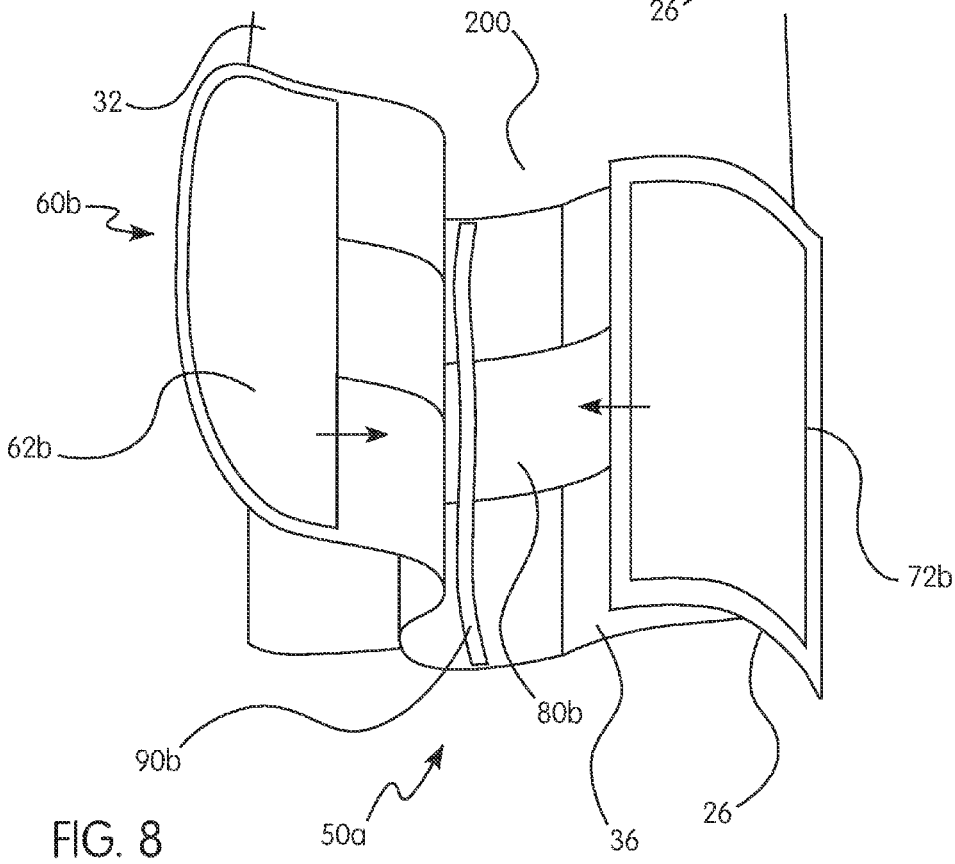
FIG. 8 illustrates another perspective view of the side closure of FIG. 6A as worn by a user while in an open state.

In the embodiment of FIGS. 1 through 8, the vest fabric encompassing side section 34 of rear ballistic panel 32 is attached (for example, sewn) to shirt 200 such that side section 34 extends at least partially around the side of shirt 200 when donned by the user (see for example, FIGS. 3 through 5 and 6A for closure mechanism 50*a* and FIG. 8 for closure mechanism 50*b*). A rear closure section 60*a* is in connection (for example, by sewing) with the rear of body armor 10. Rear closure section 60*a* is also in operative connection with a front closure section 70*a* (which encompasses side section 24 of front ballistic panel 22) via an intermediate member 80*a*. In the embodiment of FIGS. 1 through 8, intermediate member 80*a* is sewn to an underside of rear closure sections 60*a* a few inches from the end thereof, passes under a loop of material 90*a* which is attached to vest 20 and is sewn to the end of front closure section 70*a* on an upper side thereof.

After shirt 200 is donned by the user, the user can grasp rear closure section 60*a* using a single hand and pull rear closure section 60*a* forward and around the side of the user. Intermediate section 80*a*, in cooperation with loop 90*a*, causes front closure section 70*a* (and side section 24 of front ballistic panel 22 therein) to move rearward and overlap side section 34 of rear ballistic panel 32 when rear closure section 60*a* is pulled forward and around the user (see, for example, arrows in FIGS. 3-5, 6B and 7), thereby effecting a front-to-back overlap of the ballistic panels over the side of the user, while adjusting the fit of vest 20 via a back-to-front overlap of closure sections 60*a* and 70*a*. The fit of vest 20 can be adjusted to fit various size bodies by adjusting the position or amount of overlap of rear closure sections 60*a* and 60*b* on front closure sections 70*a* and 70*b*, respectively. Preferably, in all positions of fit, front side ballistic sections 24 and 26 overlap rear side ballistic sections 34 and 36, respectively.

In general, the passing of intermediate section 80*a* under loop 90*a* causes the portion of intermediate section 80*a* between loop 90*a* and front closure section 70*a* to move rearward while the portion of intermediate section 80*a* between loop 90*a* and rear closure section 60*a* moves forward.

An underside of rear closure section 60*a* includes a connection mechanism 62*a* (for example, a cooperating portion of a hook-and-loop type connecting or fastening system) that cooperates with a cooperating connection mechanism 72*a* on front closure section 70*a* to secure rear closure section 60*a* to front closure section 70*a* in a desired position to effect a desired fit of armor 10. After or simultaneously with the closure of side closure mechanism 50*a*, the user performs a similar procedure with side closure mechanism 50*b* to effect a front to back overlap of the ballistic panel sections 26 and 36 over the opposite side of the user, while further adjusting the fit of vest 20 via a back-to-front overlap of closure sections 60*b* and 70*b*.

Although the present invention has been described in detail in connection with the above embodiments and/or examples, it should be understood that such detail is illustrative and not restrictive, and that those skilled in the art can make variations without departing from the invention. The scope of the invention is indicated by the following claims rather than by the foregoing description. All changes and variations that come within the meaning and range of equivalency of the claims are to be embraced within their scope.

What is claimed is:

1. A body armor to be worn by a person, comprising:

a front section comprising ballistic paneling, the front section further comprising at least a first front laterally extending section on a first side of the body armor, the first front laterally extending section comprising ballistic paneling;

a rear section comprising ballistic paneling, the rear section comprising at least a first rear laterally extending section on the first side of the body armor;

the first rear laterally extending section being connected to the first front laterally extending section so that when the first rear laterally extending section is moved forward around a first side of a torso of the person during closure of the first side of the body armor, the first front laterally extending section is pulled to move in a rearward direction around the first side of the torso of the person and under the first rear laterally extending section thereby causing overlapping of at least a portion of ballistic paneling of the first front laterally extending section with at least a portion of ballistic paneling of the rear section around the first side of the torso.

2. The body armor of claim 1 further comprising a first length of material connected at a first end to the first rear laterally extending section and connected at a second end to the first front laterally extending section, the length of material passing through a first loop attached to the article of body armor.

3. The body armor of claim 2 wherein the first loop is attached to the underside of the first rear laterally extending section.

4. The body armor of claim 3 wherein the first length of material is attached to the first front laterally extending section at a lateral end thereof.

5. The body armor of claim 1 wherein the first front laterally extending section further comprises a fastening mechanism and the first rear laterally extending section comprises a cooperating fastening mechanism to reversibly retain the first front laterally extending section and the first rear laterally extending section in a closed state.

6. The body armor of claim 5 wherein the fastening mechanism and the cooperating fastening mechanism are hook-and-loop type fastening mechanisms.

7. The body armor of claim 1 wherein the front section further comprises at least a second front laterally extending section on a second side of the body armor, the second front laterally extending section comprising ballistic paneling; and the rear section comprises at least a second rear laterally extending section on the second side of the body armor;

the second rear laterally extending section being connected to the second front laterally extending section so that when the second rear laterally extending section is moved forward around a second side of a torso of the person during closure of the second side of the body armor, the second front laterally extending section is pulled to move in a rearward direction around the second side of the torso of the person and under the second rear laterally extending section thereby causing overlapping of at least a portion of ballistic paneling of the second front laterally extending section with at least a portion of ballistic paneling of the rear section around the second side of the torso.

8. The body armor of claim 7 further comprising a second length of material connected at a first end to the second rear laterally extending section and connected at a second end to the second front laterally extending section, the length of material passing through a second loop attached to the article of body armor.

9. The body armor of claim 8 wherein the second loop is attached to the underside of the second rear laterally extending section.

10. The body armor of claim 9 wherein the second length of material is attached to the second front laterally extending section at a lateral end thereof.

11. The body armor of claim 7 wherein the second front laterally extending section further comprises a fastening mechanism and the second rear laterally extending section comprises a cooperating fastening mechanism to reversibly retain the second front laterally extending section and the second rear laterally extending section in a closed state.

12. The body armor of claim 11 wherein the fastening mechanism and the cooperating fastening mechanism are hook-and-loop type fastening mechanisms.

13. The body armor of claim 7 wherein the front section and the rear section from at least a portion of a vest.

14. The body armor of claim 13 further comprising a shirt attached to the vest.

15. The body armor of claim 13 wherein ballistic paneling of the rear section is attached to the shirt to extend around a portion of the first side of the torso of the person and on the second side of the person when the body armor is donned and the first portion and the second portion of front section ballistic paneling are free to move relative to the shirt.

* * * * *